US010278468B2

(12) United States Patent
Pelatti

(10) Patent No.: US 10,278,468 B2
(45) Date of Patent: May 7, 2019

(54) UNIVERSAL ARRANGEMENT FOR SUITCASES HAVING SLIDING INTERNAL FRAME TO HANG GARMENT HANGERS

(71) Applicant: PLEVO LLC, Miami, FL (US)

(72) Inventor: Federico Nahuel Pelatti, Buenos Aires (AR)

(73) Assignee: PLEVO LLC, Miami, FL (US)

( * ) Notice: Subject to any disclaimer, the term of this patent is extended or adjusted under 35 U.S.C. 154(b) by 0 days.

(21) Appl. No.: 15/555,440

(22) PCT Filed: Mar. 4, 2016

(86) PCT No.: PCT/EP2016/054658
§ 371 (c)(1),
(2) Date: Sep. 1, 2017

(87) PCT Pub. No.: WO2016/139346
PCT Pub. Date: Sep. 9, 2016

(65) Prior Publication Data

US 2018/0035774 A1 Feb. 8, 2018

(30) Foreign Application Priority Data

Mar. 5, 2015 (AR) ..... P150100655

(51) Int. Cl.
*A45C 5/04* (2006.01)
*A45C 13/03* (2006.01)
*A47B 61/02* (2006.01)

(52) U.S. Cl.
CPC ..... *A45C 13/03* (2013.01); *A45C 5/04* (2013.01); *A47B 61/02* (2013.01)

(58) Field of Classification Search
CPC ..... A45C 5/04; A45C 13/03; A47B 61/02
USPC ..... 190/13 R; 206/279
See application file for complete search history.

(56) References Cited

U.S. PATENT DOCUMENTS 1,060,927 A 5/1913 Meyer
1,162,258 A 11/1915 Schnur
1,227,705 A * 5/1917 Ulrich ..... E06B 3/5045 190/13 R
2,016,520 A * 10/1935 Short ..... A45C 7/0077 190/107
2,526,142 A 10/1950 Koch
(Continued)

FOREIGN PATENT DOCUMENTS

CN 203040999 U 7/2013
FR 376958 A 8/1907
(Continued)

OTHER PUBLICATIONS

International Search Report (PCT/ISA/210) issued in PCT Application No. PCT/EP2016/054658 dated Jun. 3, 2016 (three pages).
(Continued)

*Primary Examiner* — Sue A Weaver
(74) *Attorney, Agent, or Firm* — Crowell & Moring LLP

(57) ABSTRACT

A universal arrangement for a suitcase comprising a slidable internal frame placed side by side inside the upper portion the suitcase, that may be smoothly pulled out by the user when opening the suitcase, allowing to comfortably hang garment hangers and smoothly push it back inside the suitcase.

7 Claims, 6 Drawing Sheets

(56) References Cited

U.S. PATENT DOCUMENTS

| | | | | | |
|---|---|---|---|---|---|
| 2,681,128 | A * | 6/1954 | Staffa | A45C 13/03 190/13 R |
| 4,111,309 | A * | 9/1978 | Henry | A47B 61/02 211/104 |
| D452,378 | S | 12/2001 | Chen | |
| 2014/0262659 | A1* | 9/2014 | Hirsch | A47B 61/06 190/13 R |
| 2016/0143406 | A1* | 5/2016 | Collins | A45C 5/14 53/410 |

FOREIGN PATENT DOCUMENTS

| | | | | |
|---|---|---|---|---|
| GB | 2336106 | A * | 10/1999 | A47G 25/0692 |
| JP | 60-179006 | A | 9/1985 | |

OTHER PUBLICATIONS

Written Opinion (PCT/ISA/237) issued in PCT Application No. PCT/EP2016/054658 dated Jun. 3, 2016 (five pages).

* cited by examiner

UNIVERSAL ARRANGEMENT FOR SUITCASES HAVING SLIDING INTERNAL FRAME TO HANG GARMENT HANGERS

TECHNICAL FIELD OF THE INVENTION

The present invention refers to a universal arrangement for suitcases having a slidable internal frame to hang garment hangers.

The universal arrangement for suitcases of the present invention has a slidable internal frame on top that moves when opened and is located side by side of the suitcase, allowing a space to hang garment hangers. That is, by means of this garment hanging technology inside the suitcase, it is achieved the comfort of a home closet while the user is traveling.

Problems to be Solved and State of the Art

When traveling, one of the biggest problems is cloth transportation due to the fact that clothes are folded and, when one attempts to use them, they are untidy and wrinkled. Keeping clothes in good conditions while traveling represents a great problem for users.

The present invention helps solving various problems that a user can have with clothes when traveling. The present invention helps keeping clothes hung, avoiding wrinkles said as those found when the clothes are folded in suitcases. This way, apart from the conventional purpose a suitcase has, it is achieved an original purpose for suitcase: hanging clothes while being transported. This purpose is important when traveling if a user needs clothes in perfect conditions, said as when they are hung in a closet.

Nowadays, there are several patents that attempt solving this problem but without guaranteed success. For example, patent CN 203040999 U provides a similar solution as the one mentioned herein, since it describes a suitcase in which clothes can be hung. However, there are a lot of differences in its design and features. In order to hang clothes in the suitcase of patent CN 203040999 a special garment hanger shall be needed including a front or rotary hook, and said hangers are not the ones usually used. Otherwise, special hangers might be needed that could fit sideways in the suitcase. This would require small hangers or a new hanger system, thus causing a problem to the user. And yet, if conventional hangers are used, the suitcase of said patent would have to be very wide. This would also create carrying problems, slowing down normal and comfortable suitcase dragging. Said problems do not occur with the present invention, since standard garment hangers can be used and clothes can be hung just like in any closet. The size of the suitcase will only vary according to its capacity, that is, it will only be bigger when one needs to arrange more clothes, as in any conventional suitcase, without the need to vary the size of the suitcase to hang the garment hangers. Another important difference between the invention described in the above cited document and the present invention is that the suitcase of patent CN 203040999 has a fixed bar, by which finding clothes inside the suitcase might be cumbersome. In fact, in the CN document in order to see or reach hung clothes on the bottom of the suitcase, the user is forced to move other clothes, thus wrinkling or pulling them out. On the other hand, with the present invention, hung clothes can be easily seen, since the slidable structure on which clothes are hung only needs to be slid to see all the clothes without wrinkling or pulling them out of the suitcase.

Utility model ES 0188134 U describes a suitcase with signs for public roads. Its purpose is to allow a motor vehicle driver to show the risk of danger to other vehicle users in the event of parking on the road due to a breakdown. However, the document does not describe any system that may allow hanging garment hangers tidily.

Document JPS 60179006 A describes a rigid suitcase for suits. However, unlike the present invention that is suitable for any suitcase, this document describes an object itself that is not suitable for other garment transport means. Besides, the suitcase of the above document only allows the transportation of a suit folded inside it.

Document U.S. Pat. No. 2,526,142 describes a suitcase having a structure that allows storing clothes according to a fixed order, including three fixed positions. The document mentions a suitcase and a whole system that, unlike the present invention, is not suitable for being adapted to any suitcase. The main differences between that above document and the present invention can be summarized as follows: the above document, unlike the present invention, is a suitcase to arrange clothes and the structure is fixed to the suitcase. That is, the suitcase and the structure form an assembly that can not be separated. The garments are folded and special hangers are needed. The clothes are arranged one above the other horizontally, thus making it difficult to pull the clothes out; in other words, the user would have to pull out clothes in order to reach the desired ones. Instead, the universal arrangement for suitcases of the present invention allows varying its size to fit different types of suitcases. The present invention includes a slidable system that is slid outwards from the inside and that fits any suitcase, whatever its features, size and material.

Document U.S. Pat. No. D452,378 S1 discloses a support for suitcases that allows hanging only two hangers and consists of an object without any particular mechanism or movement. Although the document shows an object to fit suitcases, its function or use are not similar to the present invention, since it merely seems to be a hook shaped member for fitting inside suitcases.

The arrangement of the present invention is designed for being vertically mounted inside suitcases, thus resembling the position of the clothes in a closet, granting and, thanks to the slidable system, the user finds more comfort when arranging/pulling out/searching for clothes. The arrangement allows hanging all types of hangers, either of shirts, jackets, ties or pants. Garments are laid out inside the suitcase; for that reason it is an easy-to-use mechanism.

DETAILED DESCRIPTION OF THE INVENTION

Figure 1:
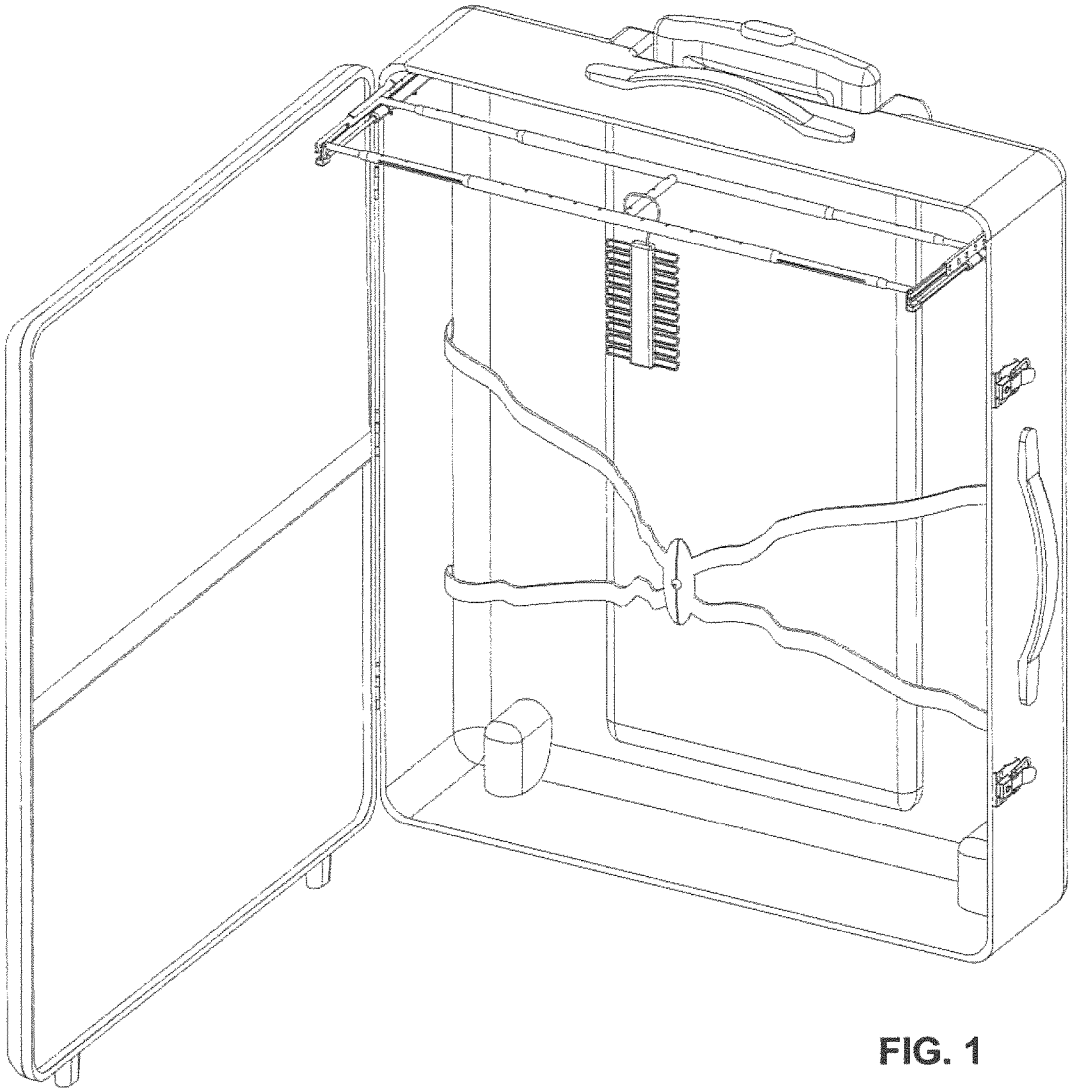
FIG. 1 shows a perspective view of the structure of the present invention.
Figure 2:
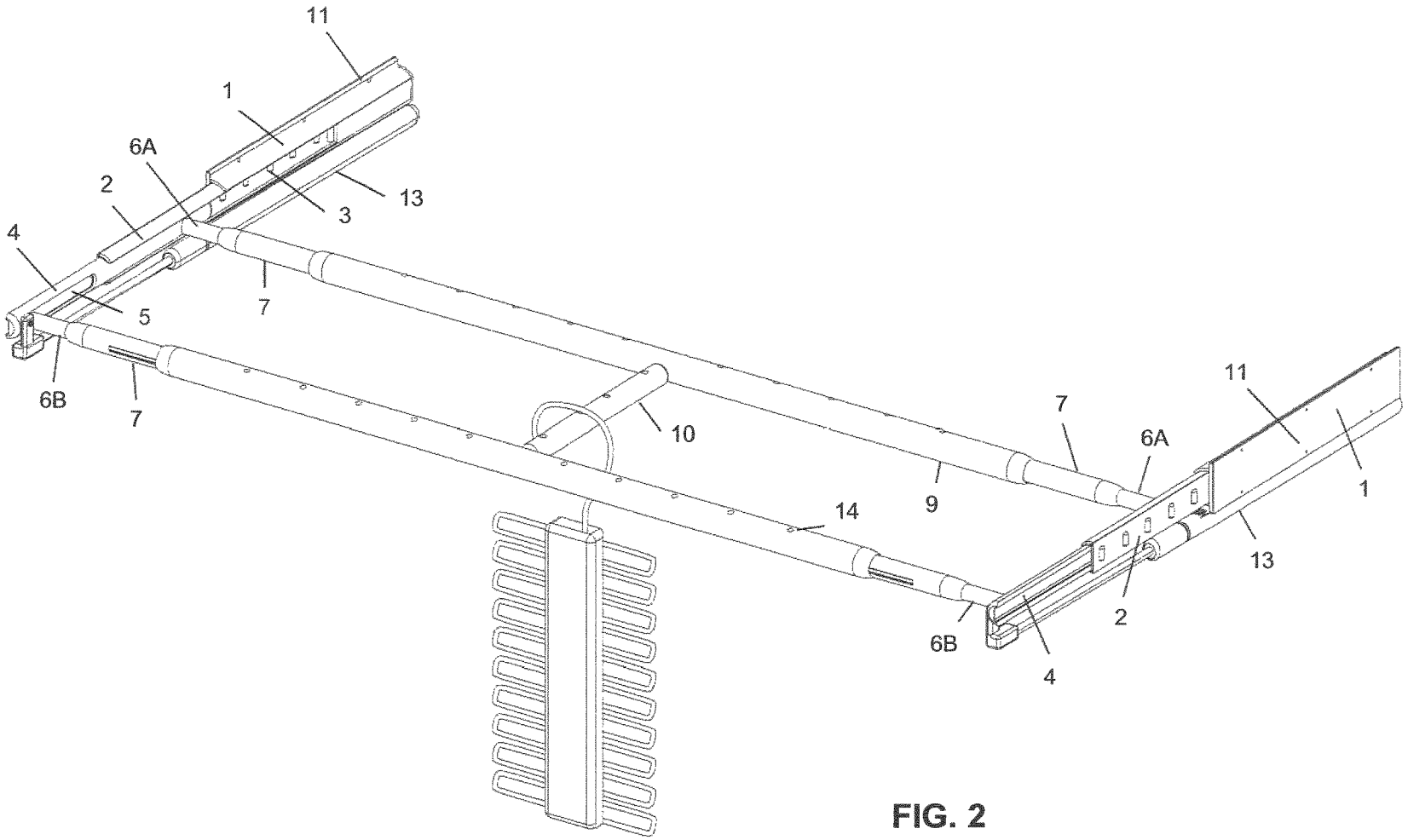
FIG. 2 shows a perspective view of the arrangement of the present invention while being used.
Figure 3:
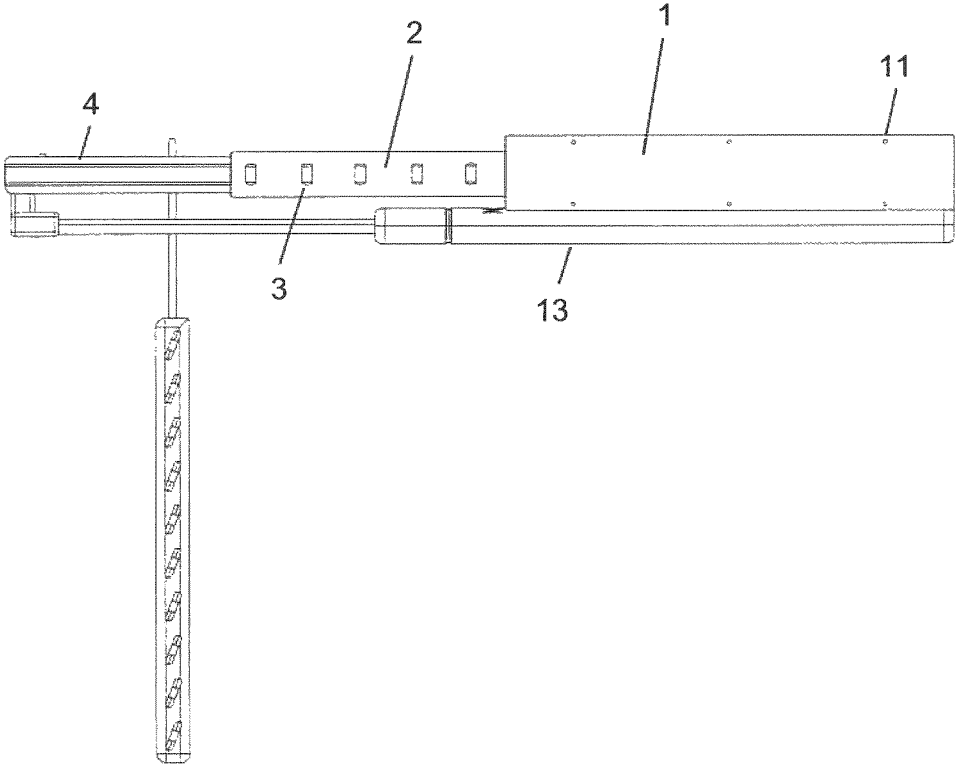
FIG. 3 shows a side view of the arrangement of the present invention.
Figure 4:
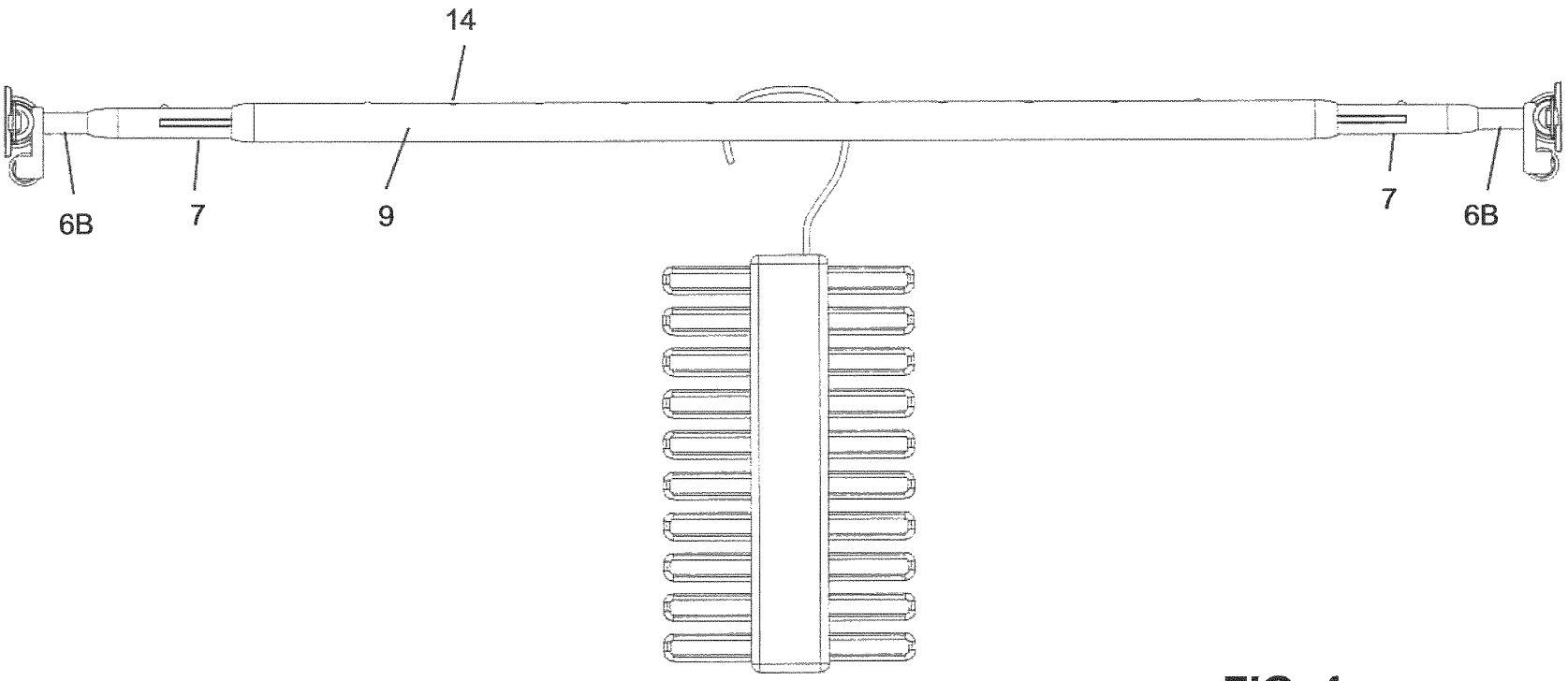
FIG. 4 shows a front view of the arrangement of the present invention with the corresponding hanger.
Figure 5:
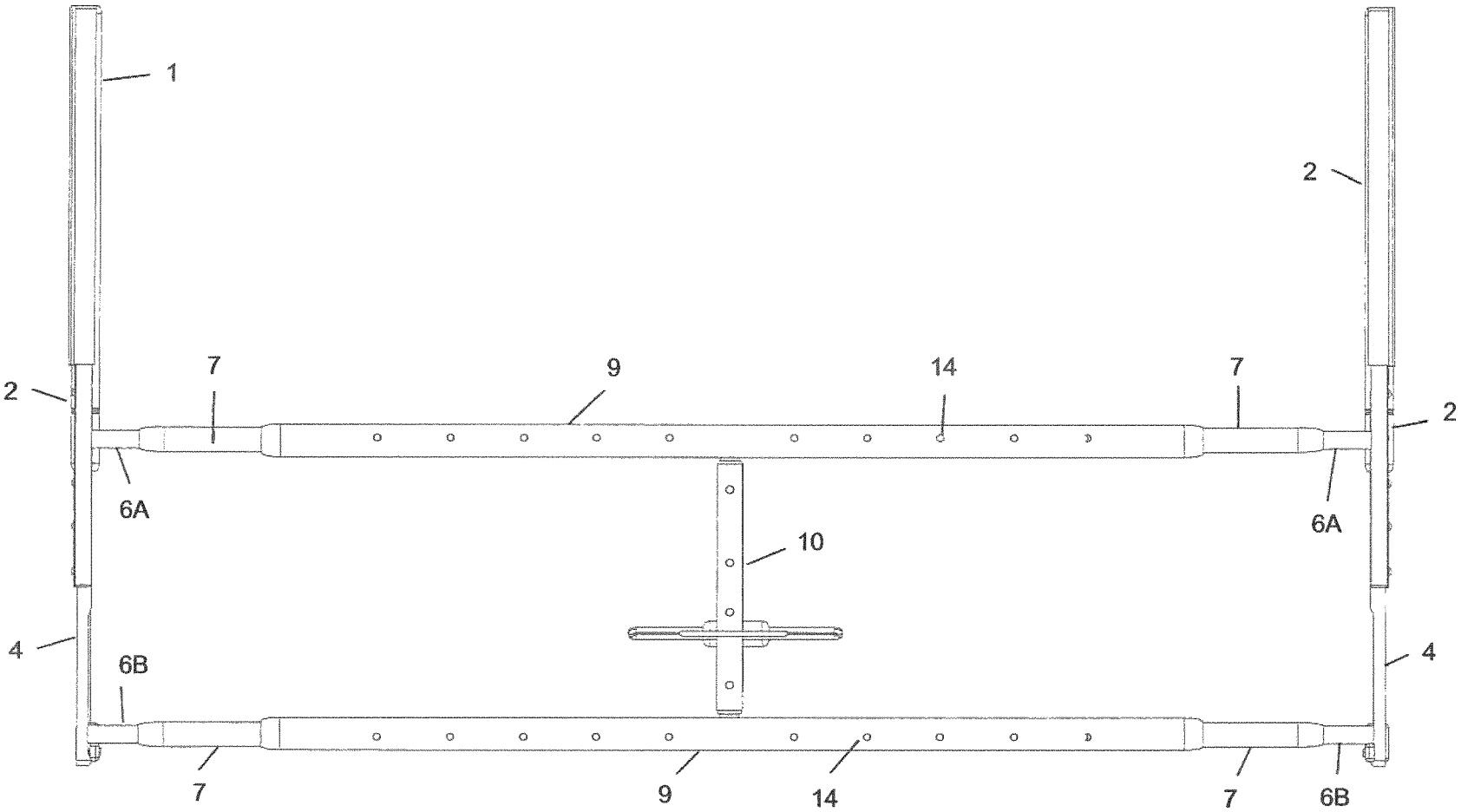
FIG. 5 shows a top view of the arrangement of the present invention.

The arrangement of the present invention has a metal structure (preferred material but not limited to it) inside the top of the suitcase, that is, near to where the handle grip is placed.

FIGS. 1-6 show that the arrangement comprises a structure with two anchoring guides (section A) 1 attached to the suitcase on its sides by screws 16 retained by means of anchorages 11 and wherein the sides 1 work as rails. Anchorages (section A) 1 allow mounting the fixed elements of the arrangement so that, once placed thereon, the slidable effect created by the user takes place, allowing to fully pull out clothes. Within each guide 1, there is a guide (section B) 2 which has a line of sliding rollers 3 against which an end guide (section C) 4 slides to extend telescopically according to the user's need, allowing to pull out of the suitcase the arrangement to access clothes. The line of sliding rollers 3 is through-pass, that is, it leans out of both sides of the guide (section B) 2. Each set of guides is fixed in its end guide 4 to a pneumatic damper 13 which allows the user to smoothly pull out the sliding arrangement and smoothly push it back to return into the suitcase. Each damper is fixed by a guide connector 18 screwed with a screw 17. Each end guide (section C) 4 comprises two cross arms 6A, 6B both mounted on the end of the guide 4 in a position that can be varied by regulating the depth (A) 5 formed by a groove within which the arms 6A, 6B can slide.

Figure 6:
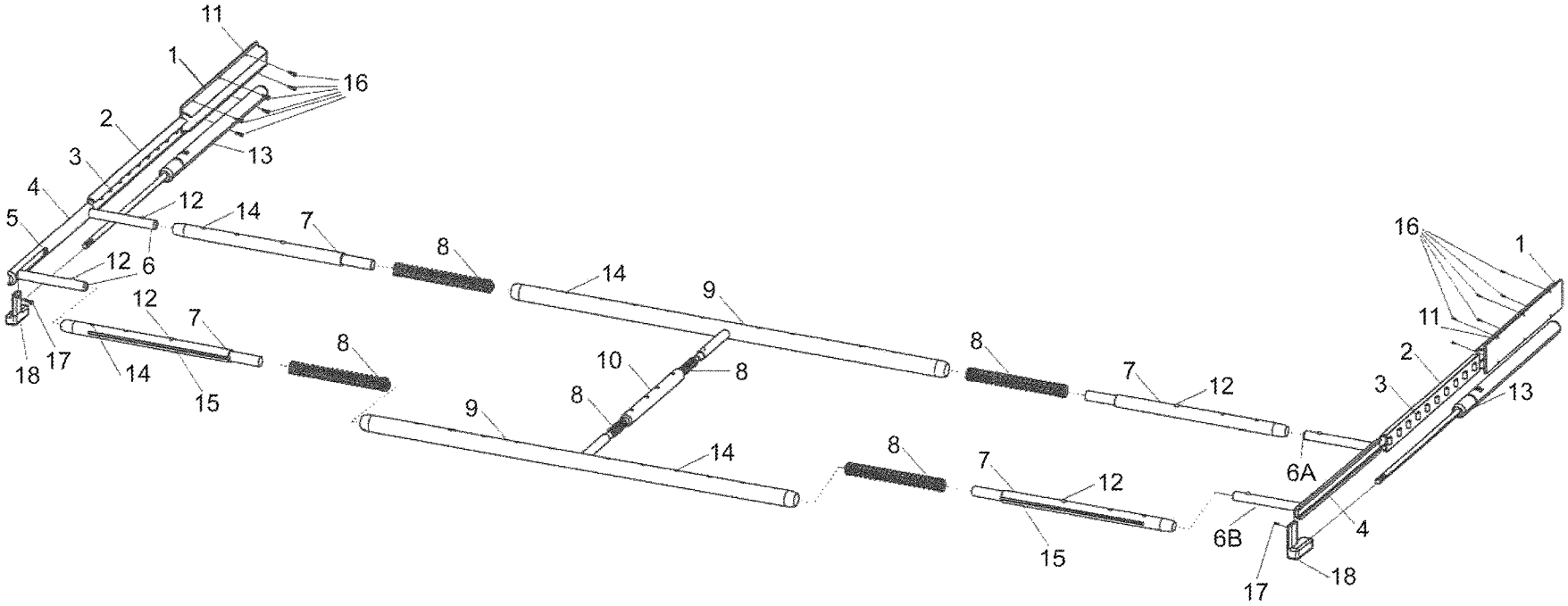
FIG. 6 shows an exploded view of the slidable structure of the arrangement of the present invention.

Continuing with FIG. 6, it may be seen that on each of the adjustable arms 6A, 6B, the cross arms 7 are snap-fitted by a pressure lock 12 arranged on each arm 6A, 6B for said purpose, and which fits the locking holes 14 and the sliding guide 15 provided on each arm 7. In turn, one end of the central section 9 is assembled to each arm 7 using compression springs 8 and also using snap-fitting locks 12 and locking holes 14 to keep them in place. This way, the two cross sections made up by the two arms 7 and one central 9 are assembled. Finally, both cross sections 9 are linked by a central coupling arm 10 which is also kept in place by two compression springs 8. The central coupling 10 also has holes in which the hangers are placed.

Therefore, the innovation of the present invention overcomes other ones. In addition, the solution proposed by the present invention cannot be considered obvious by those skilled in the art since it inventively solves the problems of the prior art. This can be verified thanks to the fact that the present invention solves the following problems of the devices of prior art:

a) There are no similar devices that can be fitted to current suitcases;

b) There is no implementation of slidable devices for suitcases; thus solving the transport and arrangement of garments into a suitcase in a similar way as in a closet.

c) In the present invention, since clothes are vertically arranged, they do not wrinkle; thus solving the unsolved problem to carry clothes without wrinkling.

d) The present invention not only solves the transport of a suit/garment without wrinkling (problem not solved yet by any suit carrier) but also allows transporting several suits/garments simultaneously.

The invention claimed is:

1. An arrangement for a suitcase with slidable internal frame to hang garment hangers comprising:

a fixed support structure comprising two anchor fixed guides (1) for fixing to the suitcase on its inner sides, and functioning as guide rails; and a slidable structure (2, 4, 6A, 6B, 7, 9, 10) to hang garment hangers and capable of sliding inside said fixed anchor guides (1) when pulled out of the suitcase by the user, wherein the slidable structure comprises:

a. two sliding guides (2);

b. two end guides (4);

c. four first adjustable cross arms (6A, 6B);

d. four second cross arms (7);

e. two cross arm central sections (9); and f. a central coupling (10) linking both cross arm central sections (9) and which has holes to hang the hangers, and wherein respective two of the four first adjustable cross arms (6A, 6B), respective two of the four second cross arms (7), and one of the two cross arm central sections (9) form one of two cross arm assemblies extending between the two end guides (4), in which the two second cross arms (7) are arranged between the two first adjustable cross arms (6A, 6B) and the cross arm central section (9).

2. The arrangement according to claim 1, wherein each sliding guide (2) comprises a line of sliding rollers (3).

3. The arrangement according to claim 1, wherein the slidable structure has a pair of pneumatic dampers (13) fixed by a connector (18) to the end of each end guide (4).

4. The arrangement according to claim 1, wherein each of said first adjustable cross arms (6A, 6B) is fixed to a corresponding end guide (4) and mounted inside a depth adjustment groove (5) that allows different positions within said groove (5).

5. The arrangement according to claim 1, wherein said second cross arms (7) are mounted to said first adjustable cross arms (6A, 6B) by a snap-fit pressure lock (12).

6. The arrangement according to claim 1, wherein said cross arm central sections (9) are mounted to said second cross arms (7) by interposing a compression spring (8) between the cross arm central sections (9) and are adjusted by a snap-fit pressure lock (12).

7. The arrangement according to claim 1, wherein said cross arm central sections (9) are mounted with said central coupling (10) by inserting a compression spring (8) and fixed by a snap-fit pressure lock (12).

* * * * *